US009631464B2

(12) United States Patent
Tao et al.

(10) Patent No.: US 9,631,464 B2
(45) Date of Patent: Apr. 25, 2017

(54) PNEUMATIC-ON-TOP COUNTERBALANCED THREE-CHAMBER CYLINDER FOR ARTIFICIAL LIFT OPERATIONS

(71) Applicant: HALLIBURTON ENERGY SERVICES, INC., Houston, TX (US)

(72) Inventors: Tao Tao, Katy, TX (US); Mathew J. McEachern, Houston, TX (US); Huajun Chen, Katy, TX (US); Yanmei Li, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/655,413

(22) PCT Filed: Jul. 8, 2014

(86) PCT No.: PCT/US2014/045681
§ 371 (c)(1),
(2) Date: Jun. 25, 2015

(87) PCT Pub. No.: WO2016/007134
PCT Pub. Date: Jan. 14, 2016

(65) Prior Publication Data
US 2016/0010438 A1 Jan. 14, 2016

(51) Int. Cl.
*E21B 43/12* (2006.01)

(52) U.S. Cl.
CPC ..... *E21B 43/126* (2013.01)

(58) Field of Classification Search
CPC ..... F04B 47/04; F04B 9/107; F04B 9/1073; E21B 43/126; E21B 43/129; E21B 43/127
See application file for complete search history.

(56) References Cited

U.S. PATENT DOCUMENTS 1,628,943 A * 5/1927 Wolcott ..... F04B 47/04 417/121
2,560,676 A * 7/1951 White ..... E21B 19/08 173/31
2,665,550 A * 1/1954 Harvey ..... F04B 47/04 60/372

(Continued)

OTHER PUBLICATIONS

International Search Report and Written Opinion issued Mar. 31, 2015 for IA PCT/US14/045667, 14 pages.

(Continued)

*Primary Examiner* — James G Sayre
(74) *Attorney, Agent, or Firm* — McGuireWoods LLP

(57) ABSTRACT

An artificial lift system for use with a subterranean well can include a cylinder having a piston reciprocably disposed therein, the piston having opposing sides, each of the opposing sides being selectively communicable with a hydraulic pressure source and a hydraulic reservoir, and the piston having another side in communication with a gas pressure source, and the gas pressure source including a gas compressor connected between gas containers. A method of controlling an artificial lift system can include connecting a cylinder to a hydraulic pressure source and to a gas pressure source, operating a gas compressor of the gas pressure source, thereby increasing gas pressure applied to the cylinder from the gas pressure source, and displacing a piston, thereby operating a downhole pump.

18 Claims, 4 Drawing Sheets

(56) References Cited

U.S. PATENT DOCUMENTS

| | | | | | |
|---|---|---|---|---|---|
| 3,058,308 | A * | 10/1962 | Smith | F04B 47/04 | 418/27 |
| 3,782,117 | A | 1/1974 | James | | |
| 3,782,247 | A * | 1/1974 | Klaeger | F01B 17/00 | 91/306 |
| 4,380,150 | A * | 4/1983 | Carlson | F04B 47/04 | 60/372 |
| 4,631,918 | A | 12/1986 | Rosman | | |
| 4,691,511 | A | 9/1987 | Dollison | | |
| 4,715,180 | A | 12/1987 | Rosman | | |
| 4,801,126 | A * | 1/1989 | Rosman | B66D 3/18 | 254/386 |
| 4,848,085 | A | 7/1989 | Rosman | | |
| 5,778,669 | A * | 7/1998 | Kubik | F15B 1/02 | 60/372 |
| 8,267,378 | B1 * | 9/2012 | Rosman | B66F 3/28 | 254/134 |
| 2007/0044654 | A1 | 3/2007 | Schedgick et al. | | |
| 2007/0068754 | A1 | 3/2007 | Furgala | | |
| 2007/0278752 | A1 | 12/2007 | Schedgick | | |
| 2009/0194291 | A1 | 8/2009 | Fesi et al. | | |
| 2010/0300679 | A1 | 12/2010 | Lorimer et al. | | |
| 2010/0300701 | A1 | 12/2010 | Bullen | | |
| 2012/0073668 | A1 | 3/2012 | Bold | | |
| 2014/0014318 | A1 * | 1/2014 | Mail | B66B 9/04 | 166/77.4 |
| 2015/0285041 | A1 * | 10/2015 | Dancek | E21B 43/126 | 417/46 |

OTHER PUBLICATIONS

International Search Report and Written Opinion issued Apr. 8, 2015 for IA PCT/US14/045698, 14 pages.

International Search Report and Written Opinion issued Apr. 9, 2015 for IA PCT/US14/045681, 14 pages.

Specification and Drawings for U.S. Appl. No. 14/646,761, filed May 22, 2015, 23 pages.

Specification and Drawings for U.S. Appl. No. 14/646,813, filed May 22, 2015, 24 pages.

* cited by examiner

PNEUMATIC-ON-TOP COUNTERBALANCED THREE-CHAMBER CYLINDER FOR ARTIFICIAL LIFT OPERATIONS

CROSS-REFERENCE TO RELATED APPLICATION

This application is a national stage under 35 USC 371 of International Application No. PCT/US14/45681, filed on 8 Jul. 2014. The entire disclosure of this prior application is incorporated herein by this reference.

TECHNICAL FIELD

This disclosure relates generally to equipment utilized and operations performed in conjunction with a subterranean well and, in one example described below, more particularly provides a pneumatic-on-top counterbalanced three-chamber cylinder for artificial lift operations.

BACKGROUND

Artificial lift systems are used to lift fluids from wells in situations in which fluid reservoir pressure is insufficient to flow the fluids to surface. It is important that artificial lift systems operate efficiently and are economical to construct, so that they are cost-effective in use. Therefore, it will be appreciated that improvements are continually needed in the art of constructing and operating artificial lift systems for wells.

DETAILED DESCRIPTION

Figure 1:
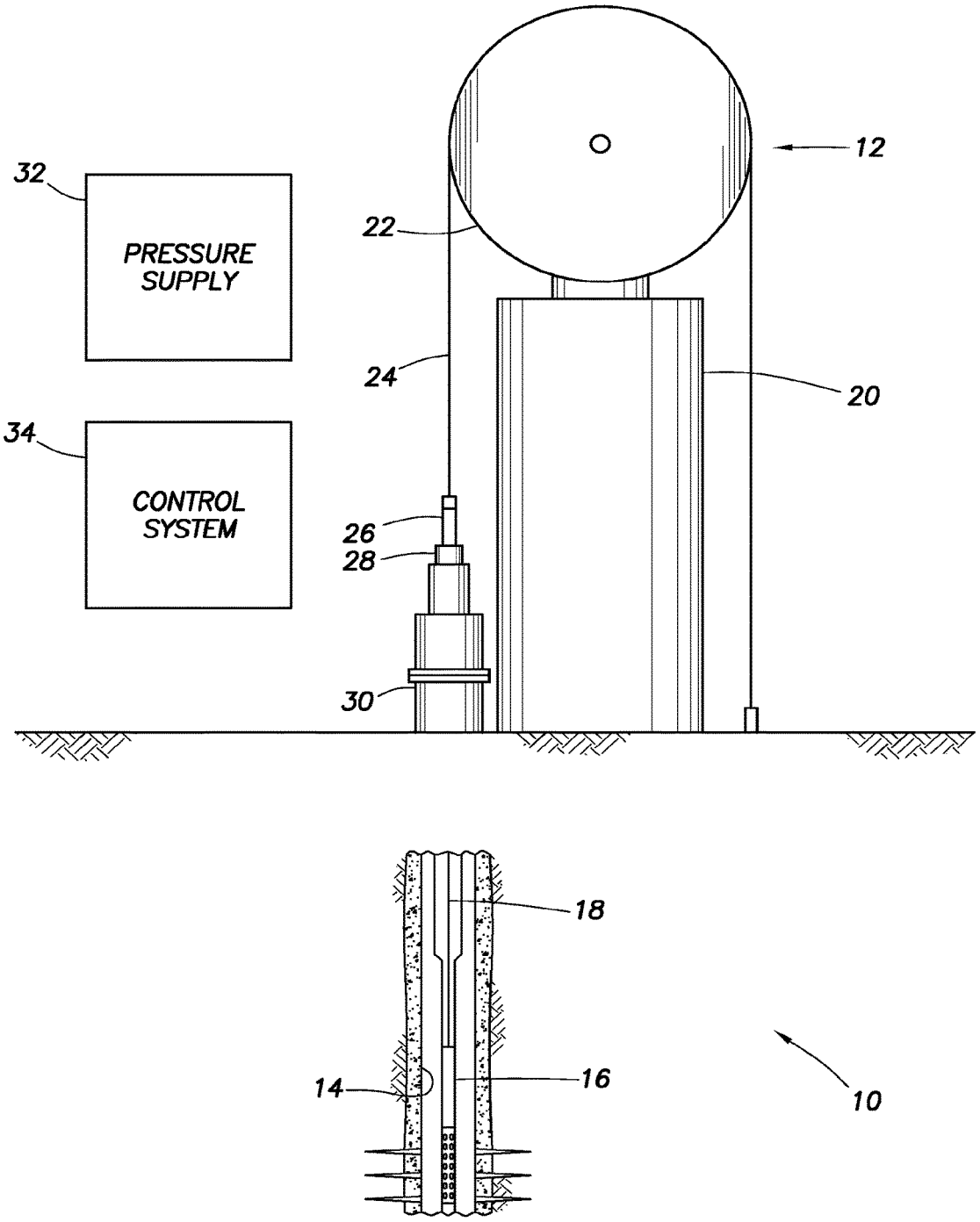
FIG. 1 is a representative partially cross-sectional view of an artificial lift system and associated method which can embody principles of this disclosure.

Representatively illustrated in FIG. 1 is a system 10 for use with a well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, an artificial lift system 12 is used to pump fluid (such as hydrocarbons, water, etc.) from a wellbore 14. For this purpose, the artificial lift system 12 includes a downhole pump 16 that is actuated by reciprocation of a rod 18 (such as, a sucker rod).

In this example, the rod 18 is reciprocated by means of a cylinder 20, sheave 22 and cable 24 at or near the earth's surface. The cylinder 20 is used to displace the sheave 22 repeatedly up and down, thereby causing an end of the cable 24 attached to a polished rod 26 to reciprocate upward and downward. Only a single sheave 22 is used in this example, but multiple sheaves may be used in other examples.

The polished rod 26 is received in a stuffing box 28 on a wellhead 30. The polished rod 26 is connected to the rod 18, so that the rod 18 is reciprocated, thereby causing the pump 16 to produce fluids upward to the wellhead 30.

A pressure supply 32 is used to actuate the cylinder 20, in order to cause the sheave 22 to displace upward and downward. A control system 34 is used to control operation of the cylinder 20 and pressure supply 32.

Figure 2:
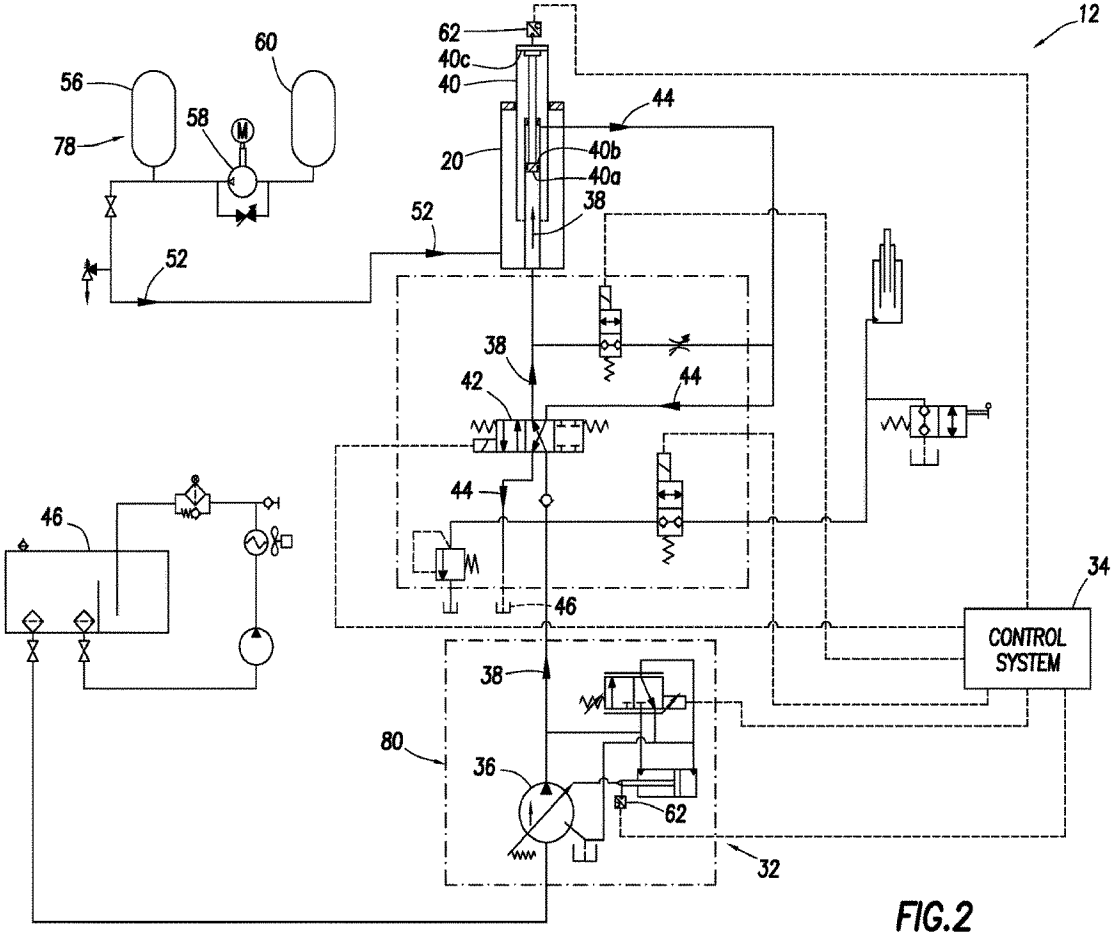
FIG. 2 is a representative hydraulic schematic for a lifting stage of operation.

Referring additionally now to FIG. 2, a schematic diagram of the artificial lift system 12 is representatively illustrated. Only the cylinder 20, pressure supply 32 and control system 34 are depicted in FIG. 2, so that the manner in which operation of the cylinder is controlled can be more clearly seen.

The pressure supply 32 includes a hydraulic pump 36 for delivering pressurized fluid 38 to a lower side 40*a* of a piston 40 in the cylinder 20. The pump 36 is a variable displacement pump with electronic proportional control in this example, but the scope of this disclosure is not limited to use of any particular type of pump.

The pump 36 and associated equipment can be considered a hydraulic pressure source 80 for delivering pressurized fluid 38 to the cylinder 20. However, other types of hydraulic pressure sources may be used in keeping with the principles of this disclosure.

The fluid 38 is directed alternately to two separate areas on the piston 40, depending on a position of a control valve 42 connected between the pump 36 and the cylinder 20. In the configuration of FIG. 1, the fluid 38 is directed to the lower piston side 40*a*.

The control valve 42 also directs a reduced pressure fluid 44 from the cylinder 20 to a fluid reservoir 46, from which the pump 36 draws. The reduced pressure fluid 44 is displaced from the cylinder 20 due to upward displacement of the piston 40. The fluid 44 is exposed to an annular area of upper piston side 40*b*.

The piston 40 displaces upward in the FIG. 2 configuration due to pneumatic pressure applied from a gas pressure source 78 to a lower side 40*c* of the piston 40, in combination with the hydraulic pressure applied to the piston side 40*a* by the fluid 38. Sufficient pressure is exerted by gas 52 on the lower side 40*c* and by the fluid 38 on the lower side 40*a* to overcome the pressure exerted by the fluid 44 on the upper side 40*b* of the piston, in addition to force required to lift the rods 18, 26, so that the piston 40 is displaced upward, thereby displacing the sheave 22 (see FIG. 1) upward.

The gas pressure source 78 includes a pressurized gas container 56 as a source of the gas 52. However, other types of gas pressure sources may be used, in keeping with the principles of this disclosure.

The gas container 56 could be, for example, a pressurized nitrogen bottle (or another pressurized inert gas container). Multiple gas containers 56 may be used if desired to provide sufficient pressurized gas volume. Thus, the scope of this disclosure is not limited to use of any particular type or number of gas container.

In the event that pressure in the gas container 56 is less than a desired level (such as, due to leakage, a requirement for more force output from the cylinder 20, etc.), a gas compressor 58 can be used to increase the pressure. The gas compressor 58 in the FIG. 2 example is supplied with gas from another gas container 60. Thus, one or more gas container(s) 56 are on a discharge side of the gas compressor 58, and one or more gas container(s) 60 are on a supply side of the gas compressor.

Having multiple gas containers 56, 60 would allow for use of readily available standard-sized pressurized bottles, thereby eliminating any need for customized gas containers to be made. However, customized gas containers may be used in keeping with the scope of this disclosure.

As depicted in FIG. 2, the cylinder 20 is extended by displacing the piston 40 upward. The piston 40 is displaced upward by operating the control valve 42 to direct pressurized fluid 38 from the pump 36 to the lower side 40*a* of the piston 40. The pressurized gas 52 continuously exerts pressure on the lower side 40*c* of the piston 40.

The pressures on the lower sides 40*a,c* of the piston 40 are sufficiently great to displace the piston upward. As the piston 40 displaces upward, the fluid 44 is discharged from the cylinder 20 and flows via the control valve 42 to the reservoir 46.

The control system 34 controls operation of the control valve 42. For example, the control system 34 will operate the control valve 42 to its FIG. 2 configuration when it is desired to upwardly displace the piston 40.

The control valve 34 receives input from a variety of sensors 62 (such as, pressure sensors, position sensors, limit switches, proximity sensors, level sensors, etc., not all of which are shown in the drawings) in the system 12, so that the control system can determine when and how to operate the control valve 42 and other equipment in the system. For example, the control system 34 can receive an indication from a sensor 62 on the cylinder 20 that the piston 40 has reached a bottom of its stroke, and in response the control system can operate the control valve 42 to its FIG. 2 configuration to thereby cause the piston 40 to displace upward.

Figure 3:
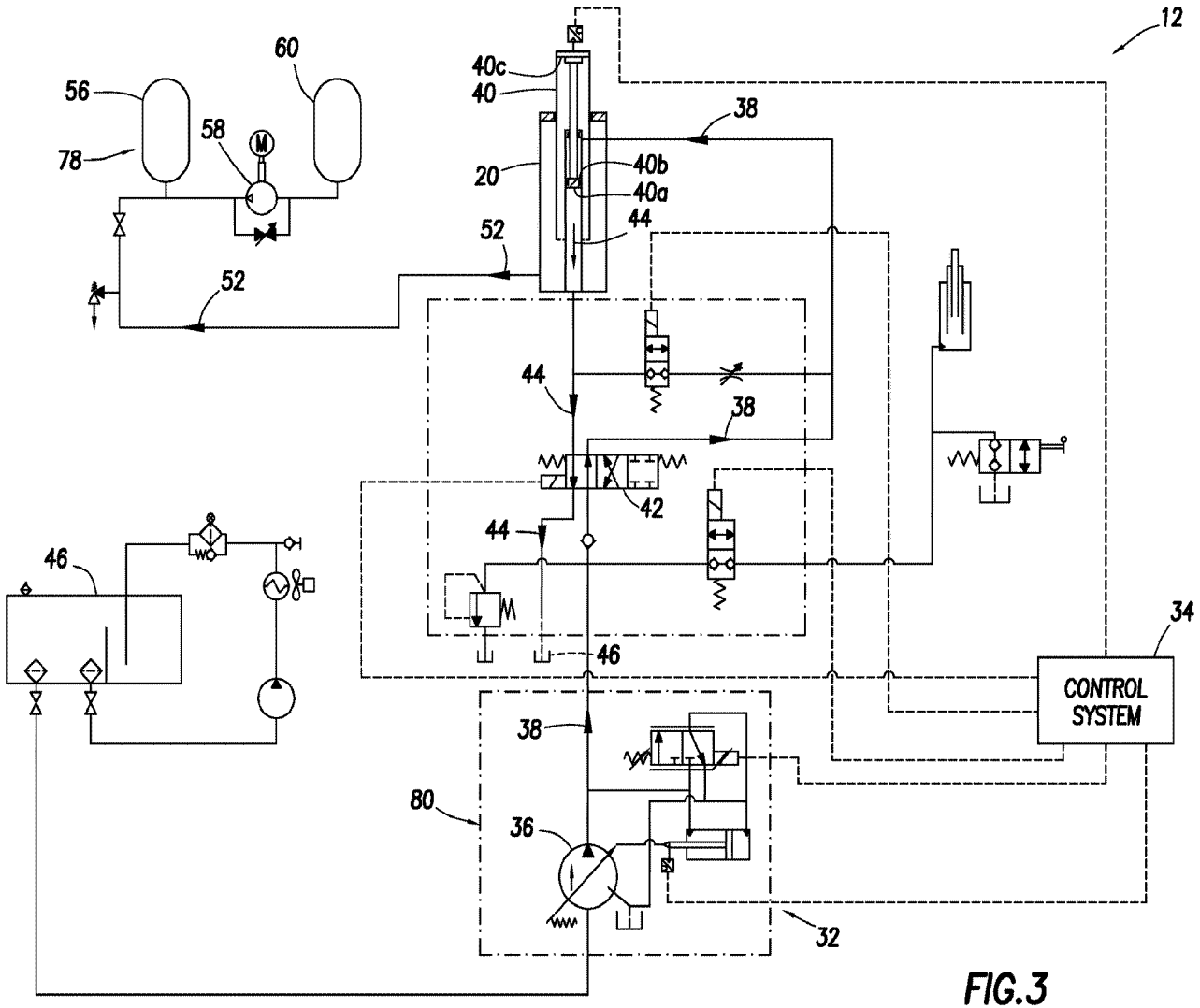
FIG. 3 is a representative hydraulic schematic for a retracting stage of operation.

Referring additionally now to FIG. 3, the system 12 is representatively illustrated in a configuration in which the piston 40 is being displaced downward. In order to downwardly displace the piston 40, the control system 34 operates the control valve 42 so that pressurized fluid 38 from the pump 36 is directed to the upper side 40*b* of the piston 40. Reduced pressure fluid 44 is directed from the lower side 40*a* of the piston 40 to the reservoir 46 by the control valve 42.

Gas 52 is flowed back to the gas container 56. The pressurized fluid 38 acting on the upper side 40*b* of the piston 40, combined with a weight of the rods 18, 26, etc., is great enough to overcome the pressurized gas 52 acting on the lower side 40*c* of the piston 40 and the fluid 44 acting on the lower side 40*a* of the piston, so that the piston 40 displaces downwardly.

The control system 34 will operate the control valve 42 to its FIG. 3 configuration when it is desired to downwardly displace the piston 40. For example, the control system 34 can receive an indication from a sensor 62 on the cylinder 20 that the piston 40 has reached a top of its stroke, and in response the control system can operate the control valve 42 to its FIG. 3 configuration to thereby cause the piston 40 to displace downward.

Figure 4:
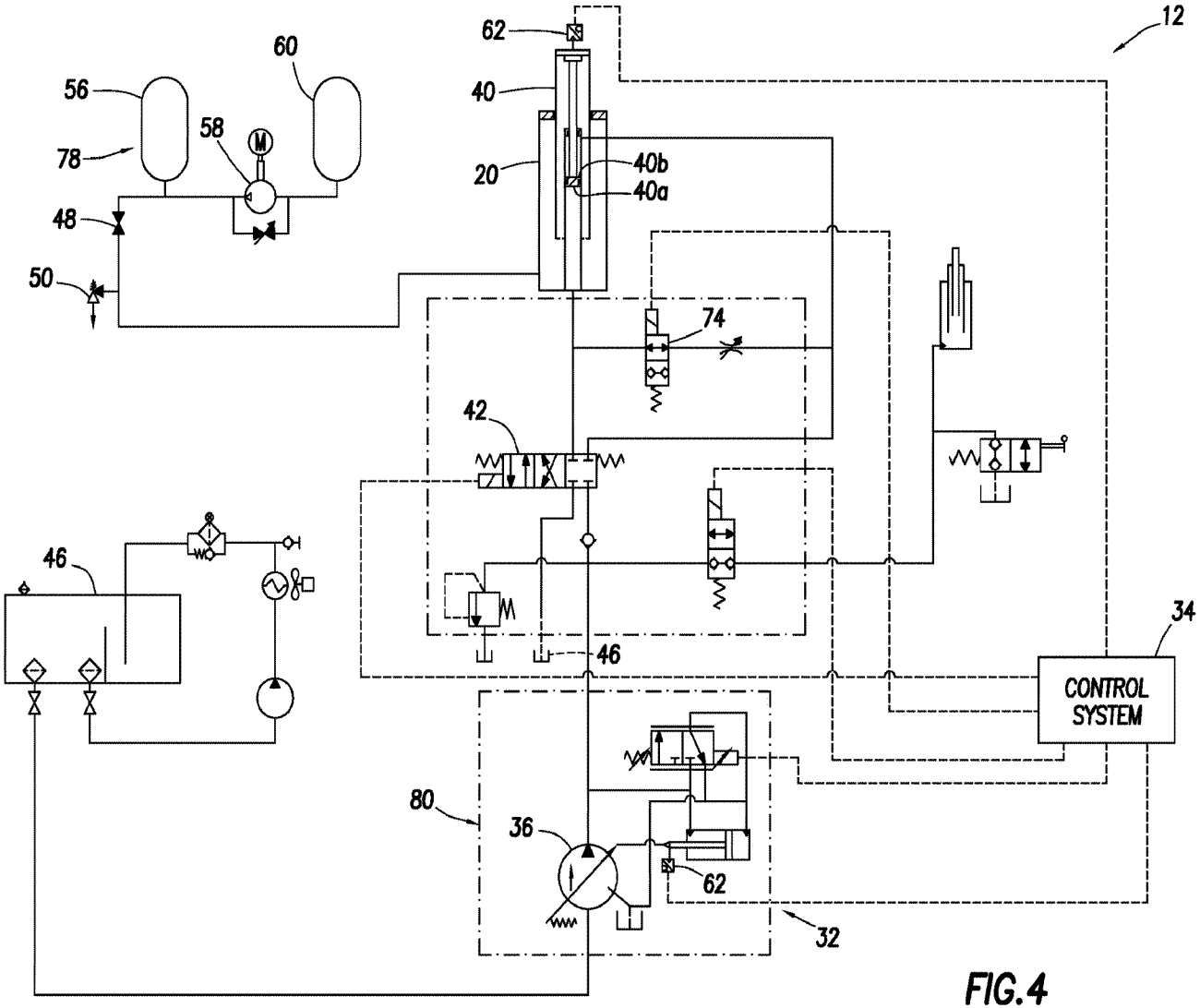
FIG. 4 is a representative hydraulic schematic for a remedial stage of operation.

Referring additionally now to FIG. 4, a configuration of the system 12 is representatively illustrated, in which the piston 40 can be displaced without use of fluid pressure. Such a configuration could be useful, for example, if the pump 36 has failed or is otherwise not operated, and it is desired to lower the piston 40, in order to perform maintenance, upgrade or repair operations on the system 12.

In this configuration, gas pressure is bled off from the cylinder 20 by closing a valve 48 and opening a bleed valve 50. The control system 34 operates the control valve 42 to a position in which the sides 40*a,b* of the piston 40 are prevented from communicating with the pump 36 and the reservoir 46.

The control system 34 also operates another valve 74 to thereby place the sides 40*a,b* of the piston 40 in communication with each other. The piston 40 will then displace downward, for example, due to the weight of the rods 18, 26, etc., applied to the sheave 22 above the cylinder 20.

It may now be fully appreciated that the above disclosure provides significant advancements to the art of constructing and operating artificial lift systems for wells. The system 12 described above is efficient, effective, responsive, and convenient and economical to construct and operate.

An artificial lift system 12 for use with a subterranean well is provided to the art by the above disclosure. In one example, the system 12 can comprise a cylinder 20 having a piston 40 reciprocably disposed therein, the piston 40 having first and second opposing sides 40*a,b*, each of the first and second opposing sides 40*a,b* being selectively communicable with a hydraulic pressure source 80 and a hydraulic reservoir 46, and the piston 40 having a third side 40*c* in communication with a gas pressure source 78, and the gas pressure source 78 including a gas compressor 58 connected between at least one first gas container 56 and at least one second gas container 60.

The first gas container 56 may be connected to a discharge side of the gas compressor 58. The second gas container 60 may be connected to an input side of the gas compressor 58.

The system 12 can also include a control valve 42. A first position of the control valve 42 may place the first side 40*a* in communication with the hydraulic pressure source 80 and place the second side 40*b* in communication with the hydraulic reservoir 46. A second position of the control valve 42 may place the second side 40*b* in communication with the hydraulic pressure source 80 and place the first side 40*a* in communication with the hydraulic reservoir 46.

The third side 40*c* can remain in communication with the gas pressure source 78 when the control valve 42 is in each of its first and second positions.

The system 12 can include a valve 74 which selectively places the first and second sides 40*a,b* in communication with each other.

Displacement of the piston 40 may displace only one sheave 22.

A method of controlling an artificial lift system 12 is also provided to the art by the above disclosure. In one example, the method can comprise: connecting a cylinder 20 to a hydraulic pressure source 80 and to a gas pressure source 78; operating a gas compressor 58 of the gas pressure source 78, thereby increasing gas pressure applied to the cylinder 20 from the gas pressure source 78; and displacing a piston 40, thereby operating a downhole pump 16.

The method can include connecting a gas container 56 to a discharge side of the gas compressor 58. The method can also include connecting a second gas container 60 to an input side of the gas compressor 58.

A well system 10 is also described above. In one example, the well system 10 includes a downhole pump 16 actuated by reciprocation of a rod 18, 26, a cylinder 20 that reciprocates the rod 18, 26 in response to pressure applied to the cylinder 20, the cylinder 20 having a piston 40 reciprocably disposed therein, the piston 40 having first and second opposing sides 40*a,b*, each of the first and second opposing sides 40*a,b* being selectively communicable with a hydraulic pressure source 80 and a hydraulic reservoir 46, and the piston 40 having a third side 40*c* in communication with a gas pressure source 78. The gas pressure source 78 includes a gas compressor 58 connected between gas containers 56, 60.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. An artificial lift system for use with a subterranean well, the system comprising:

a cylinder having a piston reciprocably disposed therein, the piston having first and second opposing sides, the first opposing side being an upper side and the second opposing side being a lower side opposing the upper first side, each of the first and second opposing sides being selectively communicable with a hydraulic pressure source and a hydraulic reservoir, and the piston having a third side in communication with a gas pressure source and disposed in the cylinder above the first and second opposing sides; and the gas pressure source including a gas compressor connected between at least one first gas container and at least one second gas container.

2. The system of claim 1, wherein the first gas container is connected to a discharge side of the gas compressor.

3. The system of claim 2, wherein the second gas container is connected to an input side of the gas compressor.

4. The system of claim 1, further comprising a control valve, wherein a first position of the control valve places the first side in communication with the hydraulic pressure source and places the second side in communication with the hydraulic reservoir, and wherein a second position of the control valve places the second side in communication with the hydraulic pressure source and places the first side in communication with the hydraulic reservoir.

5. The system of claim 4, wherein the third side remains in communication with the gas pressure source when the control valve is in each of its first and second positions.

6. The system of claim 1, further comprising a valve which selectively places the first and second sides in communication with each other.

7. The system of claim 1, wherein the artificial lift system further comprises only one sheave; wherein displacement of the piston displaces the only one sheave.

8. A method of controlling an artificial lift system, the method comprising:

connecting a cylinder to a hydraulic pressure source and to a gas pressure source, the gas pressure source being connected between at least one first gas container and at least one second gas container;

operating a gas compressor of the gas pressure source, thereby increasing gas pressure applied to the cylinder from the gas pressure source; and displacing a piston, thereby operating a downhole pump; the piston having first and second opposing sides, the first opposing side being an upper side and the second opposing side being a lower side opposing the upper first side, each of the first and second opposing sides being selectively communicable with a hydraulic pressure source and a hydraulic reservoir, and the piston having a third side in communication with the gas pressure source and disposed in the cylinder above the first and second opposing sides.

9. The method of claim 8, further comprising connecting the at least one first gas container to a discharge side of the gas compressor.

10. The method of claim 9, further comprising connecting the at least one second gas container to an input side of the gas compressor.

11. The method of claim 8, further comprising operating a control valve, wherein a first position of the control valve places the first side in communication with the hydraulic pressure source and places the second side in communication with the hydraulic reservoir, and wherein a second position of the control valve places the second side in communication with the hydraulic pressure source and places the first side in communication with the hydraulic reservoir.

12. The method of claim 11, wherein the third side remains in communication with the gas pressure source when the control valve is in each of its first and second positions.

13. The method of claim 8, wherein the artificial lift system further comprises only one sheave; wherein the displacing comprises displacing the only one sheave with the piston.

14. A well system, comprising:

a downhole pump actuated by reciprocation of a rod;

a cylinder that reciprocates the rod in response to pressure applied to the cylinder, the cylinder having a piston reciprocably disposed therein, the piston having first and second opposing sides, the first opposing side being an upper side and the second opposing side being a lower side opposing the upper first side, each of the first and second opposing sides being selectively communicable with a hydraulic pressure source and a hydraulic reservoir, and the piston having a third side in communication with a gas pressure source and disposed in the cylinder above the first and second opposing sides; and the gas pressure source including a gas compressor connected between at least one first gas container and at least one second gas container.

15. The system of claim 14, wherein the first gas container is connected to a discharge side of the gas compressor.

16. The system of claim 15, wherein the second gas container is connected to an input side of the gas compressor.

17. The system of claim 14, further comprising a valve which selectively places the first and second sides in communication with each other.

18. The system of claim 14, wherein the artificial lift system further comprises only one sheave; wherein displacement of the cylinder displaces the only one sheave.

* * * * *